US006561367B2

(12) United States Patent
Eaton

(10) Patent No.: US 6,561,367 B2
(45) Date of Patent: May 13, 2003

(54) PORTABLE HOIST AND METHOD

(76) Inventor: Wayne Eaton, Box 235 South Rd., Kensington, NH (US) 03833

( * ) Notice: Subject to any disclaimer, the term of this patent is extended or adjusted under 35 U.S.C. 154(b) by 0 days.

(21) Appl. No.: 09/977,532

(22) Filed: Oct. 15, 2001

(65) Prior Publication Data

US 2003/0071003 A1 Apr. 17, 2003

(51) Int. Cl.[7] ..... B66D 3/00
(52) U.S. Cl. ..... 212/202; 212/901
(58) Field of Search ..... 212/199, 200, 212/201, 202, 203, 901; 414/462; 254/4 R, 4 B, 8 R

(56) References Cited

U.S. PATENT DOCUMENTS

| | | | | | |
|---|---|---|---|---|---|
| 503,105 | A | * | 8/1893 | Tingley | |
| 750,166 | A | * | 1/1904 | Clay | |
| 795,524 | A | * | 7/1905 | Leffmann | |
| 1,090,248 | A | * | 3/1914 | Toepfer | |
| 1,134,707 | A | * | 4/1915 | Stone | |
| 1,380,779 | A | * | 6/1921 | Craig | |
| 1,428,887 | A | * | 9/1922 | Hescock | |
| 2,615,584 | A | * | 10/1952 | Adams | |
| 2,974,809 | A | * | 3/1961 | Sellar et al. | |
| 3,263,822 | A | * | 8/1966 | Weinman | |
| 3,711,877 | A | * | 1/1973 | Averill | 5/81 |
| 3,817,081 | A | * | 6/1974 | Morski et al. | 72/462 |
| 3,907,252 | A | | 9/1975 | Gaarder | |
| 3,917,094 | A | * | 11/1975 | Magneson | 214/450 |
| 4,030,705 | A | | 6/1977 | Bontrager | |
| 4,118,010 | A | | 10/1978 | Hanscom | |
| 4,458,785 | A | * | 7/1984 | Bushnell | 187/9 |
| 4,723,756 | A | | 2/1988 | Stumpf, Jr. | |
| 5,064,079 | A | | 11/1991 | Bowerman | |
| 5,195,726 | A | * | 3/1993 | Kaner | 254/325 |
| 5,281,078 | A | | 1/1994 | Mills, Jr. | |
| 5,340,082 | A | | 8/1994 | Holloway | |
| 5,375,963 | A | | 12/1994 | Wohlwend | |
| 5,520,498 | A | | 5/1996 | DiBartolomeo | |
| 5,645,272 | A | | 7/1997 | Brennan, Sr. | |
| 5,667,352 | A | * | 9/1997 | Curtin et al. | 414/667 |
| 5,758,785 | A | * | 6/1998 | Spinosa et al. | 212/300 |
| 5,934,490 | A | | 8/1999 | Mora | |
| 6,050,548 | A | * | 4/2000 | Leger | 254/326 |
| 6,056,272 | A | | 5/2000 | Sayler | |
| 6,065,621 | A | | 5/2000 | Fatemi et al. | |
| 6,129,226 | A | | 10/2000 | Donovan | |
| 6,164,625 | A | | 12/2000 | Shockley et al. | |

* cited by examiner

*Primary Examiner*—Thomas J. Brahan
(74) *Attorney, Agent, or Firm*—Robert R. Deleault, Esq.; Mesmer & Deleault, PLLC

(57) ABSTRACT

A portable hoist has a U-shaped base, a tail assembly with at least a tail leg, an adjustable, telescoping mast secured to the base, a transverse lifting beam secured to the top of the mast and having a roller at each end, and a lifting system attached to a lower portion of the mast and adjacent the base. The lifting system has a winching mechanism and a lifting cable that extends vertically from the winching mechanism to one of the rollers of the lifting beam, across to the second roller and downwardly ending in a free end.

14 Claims, 4 Drawing Sheets

PORTABLE HOIST AND METHOD

BACKGROUND OF THE INVENTION

1. Field of the Invention

The present invention relates generally to the field of equipment hoists used to vertically move various heavy vehicle components during maintenance or repair. Particularly, the present invention relates to a portable hoist, which may be positioned into a narrow workspace.

2. Description of the Prior Art

Portable hoists are conventionally used to lift and lower automobile components in the automotive repair and maintenance industry, for example transmissions, engine blocks, automobile rear ends and the like. Conventional portable hoists generally consist of a transverse beam, an upright member and a mechanical lifting device carried by some type of base. Typically, to hoist an engine, the base of the portable hoist is rolled under the automobile, the vertical mast is outside of the vehicle and against or near the outside panels of the vehicle and the hoist is positioned such that the transverse beam and lifting mechanism is over the center of the engine to be hoisted.

Establishments or shops where large vehicles, such as dump trucks, tractor trailers and the like, are serviced often need to raise, or support, heavy or bulky components (not requiring a full transmission lift) located within the engine compartment or underneath the truck, such as a steering box or portions of the transmission. Currently available lifts and hoists are too large and bulky to perform such tasks and require the user in two different physical locations, one to position the hoist and another to attach the hoist to the item to be hoisted. For the smaller, yet heavy and bulky components, the mechanic must physically hold the component by himself or with the help of another mechanic.

While well known conventional portable hoists generally have the same three main components, the configuration and geometry vary in several ways. First, the bases are of several types. Some are shaped like a "V" or "H," and others as squares and rectangles while others still are telescoping or otherwise adjustable. Second, the hoists have upright members, which may or may not be adjustable. Third, the hoists have transverse beams that are either cantilevered, or supported on each end by the base. Lastly, like the upright member, the hoists with transverse beams may or may not be telescoping or otherwise adjustable. Regardless of the configuration, however, conventional hoists are generally supported by wheels, which provide the hoist with mobility.

Although various types of portable equipment hoists have been developed for lifting heavy automotive components, they have not been altogether satisfactory for use under large vehicles for components of intermediate size such as steering boxes or portions of a transmission.

U.S. Pat. No. 5,375,963 discloses a portable hoist with a rectangular shaped base from which a non-adjustable vertical mast upwardly extends. Pivotally connected to the mast is a telescoping transverse beam to which a linearly movable shackle bracket is secured. The transverse beam is moved vertically by a lifting ram pivotally connected to the mast end of the transverse beam and secured to the mast. There are several disadvantages to using this hoist in large vehicle maintenance. For example, the movable shackle and transverse beam must be coordinated together in order to position the rigging over the center of the component to be lifted. When working underneath a large vehicle there is no space to perform such adjustments. Additionally, when the rigging is attached to the shackle bracket it is done so at an acute angle, thus, making it impossible to lift the component out of the automobile in a true vertical plane. This requires extra care and unnecessary manual movement and guidance of the heavy component to ensure that it does not collide with, or otherwise damage, any other components of the automobile.

U.S. Pat. No. 6,164,625 discloses a portable "V" base hoist that is manufactured in such a way, and containing so many components, that it can be easily disassembled by one person. While this may be useful, it undoubtedly increases the cost, and simplicity, of a portable hoist. This device operates in much the same manner as the above prior art and has the same disadvantage of lifting the heavy component on an angle.

U.S. Pat. No. 4,118,010 discloses another portable hoist that is manufactured with several adjustable and removable components and also lifts heavy components on an angle.

U.S. Pat. No. 5,934,490 discloses a variably oriented "H" shaped multi hinged base from which an adjustable, vertical, column extends. A removable, adjustable, cantilever boom is pivotally attached to the vertical column along which a wire rope is run. The wire rope is connected at one end to a winch, located on the vertical column, and on the other end to lifting rigging located at the distal end of the removable boom. While this device lifts the automobile component in a true vertical plane, it is comprised of a large number of parts, thus, making it expensive to manufacture as well. Additionally, the "H" shaped base of this device occupies valuable floor and technician workspace when in use and is cumbersome to maneuver.

While these known devices may be suitable for their intended use, none can be installed and operated underneath a vehicle within small, accessible spaces while being easy to maneuver when in use and both simple to manufacture and use. The present invention fulfills a long felt need for a compact, portable hoist having the capability to be positioned underneath the truck within the engine compartment or along the drive train of the truck to vertically lift and lower, or support, heavy or bulky intermediate-sized vehicle components in a true vertical plane during maintenance or repair, and to be adjustable by the user while in a reclined position under the vehicle.

Therefore, what is needed is a portable hoist that employs a mechanical lifting device for lifting heavy or bulky vehicle components. What is further needed is a portable engine hoist that ensures the component will be lifted vertically. What is still further needed is a portable hoist that is simple and can be easily and efficiently manufactured. Yet what is also needed is a portable hoist that uses the advantages of the prior art but overcomes the disadvantages normally associated with their use for example, fitting underneath a truck within small spaces that are too small for conventional hoists. What is also further needed is a portable hoist that allows the user to adjust the position and height of the hoist as well as operating the lifting mechanism while the user is at the location of the component to be hoisted, and/or in a reclined position under the vehicle.

SUMMARY OF THE INVENTION

It is the object of the present invention to provide an improved portable hoist that can lift heavy or bulky vehicle components vertically from above the component. It is another object of the present invention to provide a portable hoist that is simple and can be easily and efficiently manufactured. It is still another object of the present invention to provide a portable hoist for lifting vehicle components that fits underneath a truck into spaces that are too small for conventional hoists. It is yet another object of the present invention to provide a portable hoist that allows a user to adjust the position and height of the hoist as well as to operate the lifting mechanism while the user is at the location of the component to be lifted such as in a reclined position.

The present invention achieves these and other objects by providing a portable hoist having a U-shaped base, a tail assembly having at least a tail leg attached to the base, a telescoping vertical mast extending from the U-shaped base, a cantilevered lifting beam attached to the top of the vertical mast, and a mechanical lifting system having a winching mechanism with a lifting cable attached adjacent to the back of the lower portion of the vertical mast near the base where the lifting cable of the lifting system passes across the cantilevered beam from the back of the portable hoist to the front of the portable hoist. Because of its U-shaped base and relatively compact design, the hoist is nimble and easily positioned underneath trucks and within tight spaces where conventional hoists cannot be positioned.

The base of the present invention is provided with a transverse base member which has a pair of wheels attached to the bottom of the base member near each end. A pair of spaced base legs are connected to the front side of the base member. Wheels or other means for rolling support are attached to the bottom of the base legs at the end opposite the base support.

The tail assembly provides the hoist of the present invention with stability when in use by providing a counter moment to the turning moment transmitted through the cantilevered lifting beam and vertical mast. The tail assembly may also provide a mast coupler for mounting the vertical mast to the base and for securing the lifting mechanism to the hoist. The tail assembly may also include a tail plate having a top side, a bottom side, a front and a back, a tail tube (also called the mast coupler) secured to the top side, a tail wing mounted vertically to the top side of the tail plate and abutting the tail tube at approximately its center, and a tail leg secured to the bottom side of the tail plate near the back of the tail plate. The tail leg projects in a downwardly, angled position terminating with a wheel or other rolling support. The tail wing has an aperture for securing the bottom end of the winching mechanism. The tail assembly is secured to the top surface of the base support.

The telescoping mast includes lower mast, a middle mast and an upper mast. The tail end of the lower mast is inserted into the tail tube of the tail assembly. Because the mast is adjustable, the hoist can be used to hoist components on a truck while the truck is either on the shop floor or raised on a lift, jack or ramp. The middle mast is telescopically received within the lower mast and the upper mast is telescopically received within the middle mast. The lower mast has one through hole near its top end. The middle and upper mast sections have a plurality of through holes, which are similar in size and location. Removable pins, bolts, rods, and the like sized to fit the holes in the mast components allows for vertical height adjustment of the mast. The lower mast has one through hole and a lifting device hold down element. The hold down element is affixed to the back of the lower mast and is used for holding the upper end of the winch of the mechanical lifting system.

The cantilevered lifting beam having a front end and a back end is horizontally attached to the top of the upper mast nearer its back end than its front end and includes a roller or rotatable wheel at each end of the beam. The rollers rotatably support the lifting cable of the lifting system. The beam is braced by an angular brace member between the lifting beam and the upper mast. The cantilevered lifting beam provides the means for supporting the weight of the component when the hoist is in use.

The mechanical lifting system provides the present invention with the mechanical advantage for hoisting the heavy or bulky component. The lifting device of the lifting system is located on the back side of the hoist, i.e. the opposite side of the hoist from which the base legs protrude. The lifting device is located between the hold down element and the aperture of the tail wing such that the user can easily operate the winching mechanism when both the hoist and technician are underneath the truck. The lifting device may also swivel about its hold down connections providing the user the ability to make height adjustments to the hoisted component without having to move around to the location of the winching mechanism.

The lifting system also includes the lifting cable that is preferably a wire rope, which is run upward along the mast, threaded though the lifting beam, run across the rollers and extended downward from the lifting beam. A lifting shackle is secured to the free end of the lifting cable.

When an operator desires to hoist a heavy or bulky component the invention is rolled underneath the truck. The nimbleness of the U-shaped base allows the cantilevered lifting beam and lifting shackle to be positioned directly over the center of the vehicle component to be lifted. The vertical mast is then adjusted, if needed, by telescoping the middle and upper mast sections to the desired height, aligning a pair of through holes located in each of the mast sections then inserting a bolt, cotter pin or the like, through the aligned holes. Next, the lifting system is operated by attaching the lifting cable and securing the lifting shackle directly or indirectly to the component. The handle of the winch is then operated to tighten the lifting cable sufficiently to support the vehicle component. The component will lift in a true vertical plane. No further adjustment or movement of the hoist, or component, is needed. If desired, the hoist with the component attached may be removed to some remote location.

When an operator desires to install a heavy or bulky component the vertical mast is adjusted, if needed, to the appropriate height as described above and the component is secured to the lifting shackle. The invention is then rolled into position under the truck where the component is to be installed. Next, the mechanical winch is operated to lower the component into the desired spot with no further adjustment or movement of the hoist. Once the component is installed in place, the lifting shackle is disengaged and the hoist can be removed from underneath the truck.

Due to its configuration, the hoist of the present invention is stable when hoisting or supporting a load. At no time does the user/technician need to worry that the hoist base wheels will become airborne or that the load will shift or otherwise cause the hoist to fall over. The present-invention also uses a minimum number of parts. Further, the present invention is still more of an improvement because it can be easily positioned under a truck. An additional improvement is that its mechanical operation and configuration makes the present invention nimble enough to reach vehicle components, yet occupies a relatively small amount of space when in use and does not require the connection of electric or pneumatic power to operate.

Further objects and advantages of this invention will be made apparent in the following description, references being made to the accompanying drawings illustrating the preferred embodiment of the invention.

DETAILED DESCRIPTION OF THE PREFERRED EMBODIMENT

For the purpose of promoting an understanding of the principles of the present invention, references will now be made to one of the preferred embodiment(s) of the present invention as illustrated in FIGS. 1–7, using specific language to describe the same.

Figure 1:
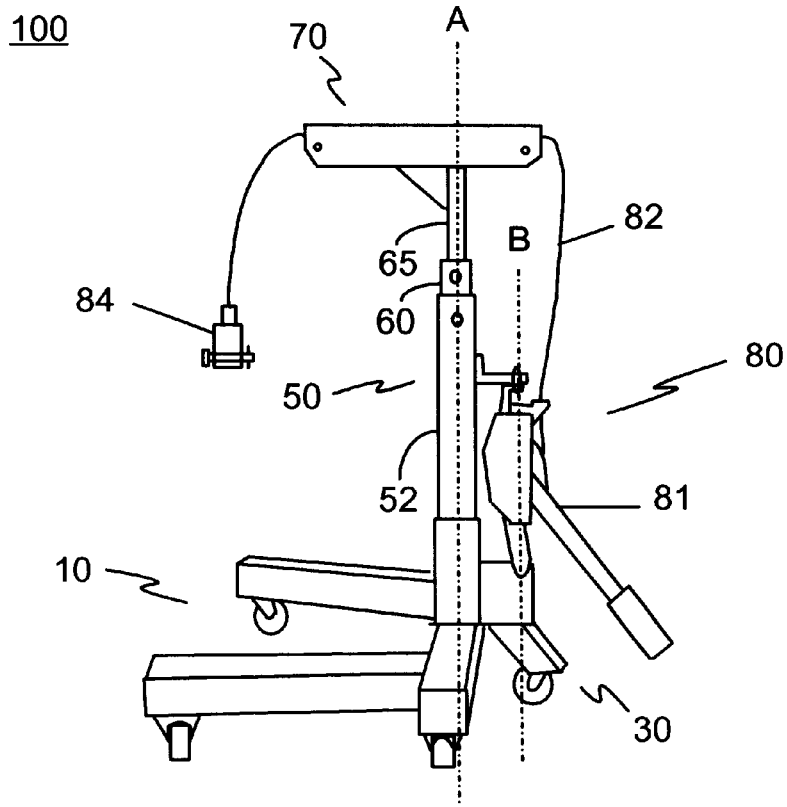
FIG. 1 is a perspective view of a preferred embodiment of the present invention.

Referring now to FIG. 1, hoist 100 is used to lift, lower and support heavy or cumbersome components found in large vehicles. Steering boxes, portions of transmission and automobile rear ends are examples of the types of components that will best be hoisted by the present invention. Large trucks, including dump trucks, cement trucks and tractor trailers are examples of the types of vehicles that can be serviced by the present invention. Hoist 100, and corresponding parts, are preferably made from a metal material exhibiting the desired characteristics required for hoists, preferably mild or low carbon steel. Hoist 100 includes a base 10, a tail assembly 30, a vertical mast 50, a lifting beam system 70, and a lifting system 80.

Figure 2:
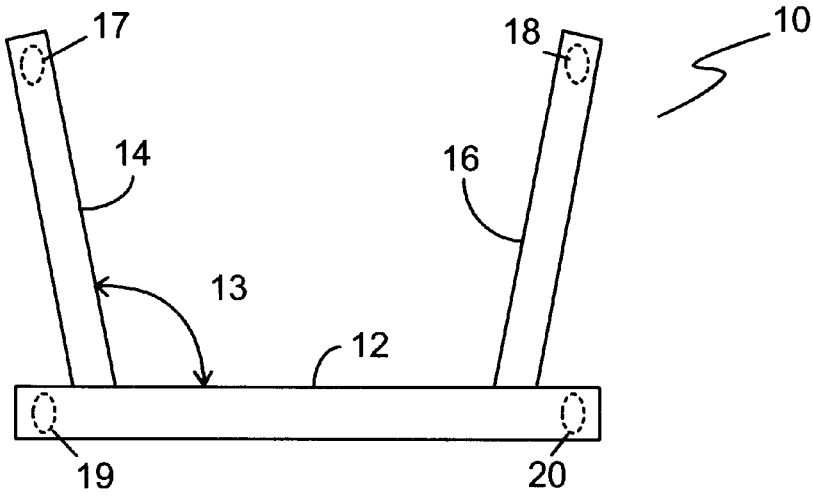
FIG. 2 is an enlarged top view of the base of the present invention.

As shown in FIG. 2, base 10 is preferably U-shaped and includes transverse base member 12 and two diverging base legs 14 and 16. Base member 12 and base legs 14 and 16 are made of a rigid material preferably made from mild or low carbon steel. Base 10 is made with either round tubular, or channel, or square or rectangular tubular material, or a combination thereof. Legs 14 and 16 are secured to base member 12 preferably by welding.

Base legs 14 and 16 are in a transverse relationship with base member 12, which is supported vertically on both ends by wheels 19 and 20. The ends of base legs 14 and 16 are welded, or otherwise affixed, to base member 12 at or near its ends. For stability, base member 12 is preferably of a length that exceeds the length of either of base legs 14 and 16. For example, in the preferred embodiment illustrated in FIG. 2, legs 14 and 16 are preferably about 16 inches in length and diverge from base member 12 at an obtuse interior angle θ of about 103 degrees. Legs 14 and 16 are preferably positioned such that they are each attached to base member 12 a distance of about 3 inches from their respective ends of base member 12, which is preferably 24 inches in length. Base member 12 and legs 14, 16 are made from square 2½ inch steel tube with a wall thickness of about ⅛ inches.

Preferably, legs 14 and 16 are vertically supported by wheels 17 and 18. Wheels 17 and 18 are attached to the underside of the distal diverging ends of legs 14 and 16. Base member 12 is vertically supported in the same manner by wheels 19 and 20. Wheels 19 and 20 are attached to the underside of base member 12 at or near each opposing end. Wheels 17, 18, 19, and 20 on base legs 14, 16 and base member 12, are adapted to roll smoothly across garage floors or other support surfaces and are preferably made of steel. However, any other wheels capable of supporting the weight of the component to be lifted may be used. Wheels 17, 18, 19, and 20 are bolted or otherwise affixed in their respective places and, preferably, may swivel when attached in their respective place. While wheels 17, 18, 19, and 20 are used in the preferred embodiment to roll hoist 100 across garage floors it is not necessary and other means, such as coasters or sliding or dragging the present invention may also be used.

Figure 3:
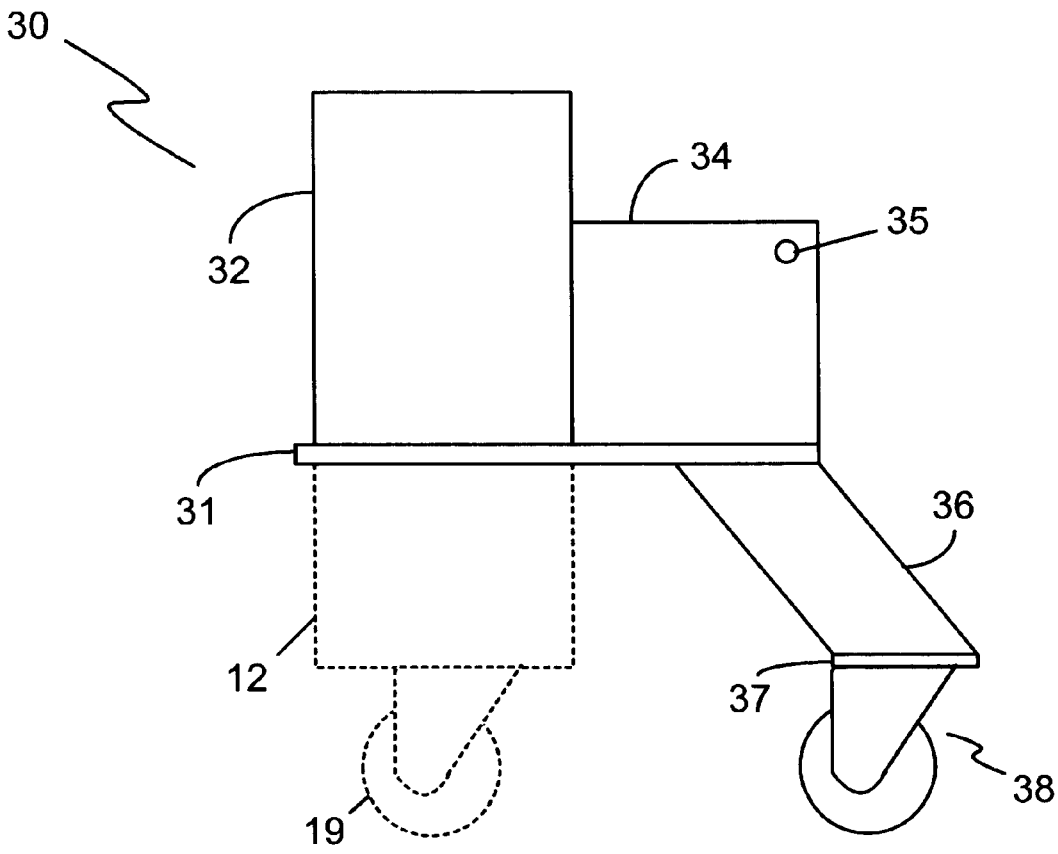
FIG. 3 is a side view of the present invention showing the tail assembly.

Turning now to FIG. 3, tail assembly 30 includes a tail plate 31, a tail tube 32, a tail wing 34, and a tail leg 36. Tail plate 31 is preferably a ¼-inch thick plate made of the same material used in base 10. All other components of tail assembly 30 are vertically attached to tail plate 31, preferably by welding. Tail tube 32 is a short, tubular, rectangular or square cross-sectional member, is vertically attached upwardly near the front and top of tail plate 31. Tail wing 34, preferably a ¼-inch thick plate like that of tail plate 31, is vertically attached to the top of tail plate 31 such that it abuts, and is perpendicular to, tail tube 32. It is preferably located along the centerline of tail plate 31 from front to back. Tail wing 34 also includes a tail wing hold down aperture 35. Tail wing 34 may or may not be welded to tail tube 32 at the abutment.

Tail leg 36, which is preferably a tubular, rectangular or square cross-sectional member, is attached at one end to the bottom of tail plate 31, opposite tail tube 32, in a downward, angular position away from base support 12, preferably at about a 45 degree angle. A foot plate 37 is preferably welded to the bottom end of tail leg 36. Bolted, or otherwise secured, to foot plate 37 is preferably a wheel 38, which is similar to wheels 17, 18, 19, and 20 on base 10 shown in FIG. 2. In the preferred embodiment, the components of tail assembly 30 are of such sizes that tail tube 32 is spaced from the front of tail plate 31, and tail wing 34 and tail leg 36 are also spaced from the back of tail plate 31 sufficient to provide a ledge for welding the components together. The tail plate can, however, be flush with the edges of the components of tail assembly 30. This may simply make welding more difficult.

Tail assembly 30 is attached, preferably by welding, to base support 12 such that the center of tail tube 32 is located in the center of base support 12 between the converging ends of base legs 14 and 16. In the preferred embodiment, tail plate 31 is a rectangular piece of ¼ inch flat, steel stock that is about 6.5 inches long by about 3.5 inches wide. Tail tube 32 is a 3-inch by 3-inch square tube with 3/16 inch walls cut to a length of about 6 inches. Tail wing 34 is a rectangular piece of ¼ inch flat, steel sheet that is about 3 inches long by about 3.5 inches high with a ⅜ inch hole 35 spaced from the upper right-hand corner as shown in FIG. 3, and tail leg 36 is made from 2 inch by 2 inch square tube with ⅛ inch wall.

Figure 3A:
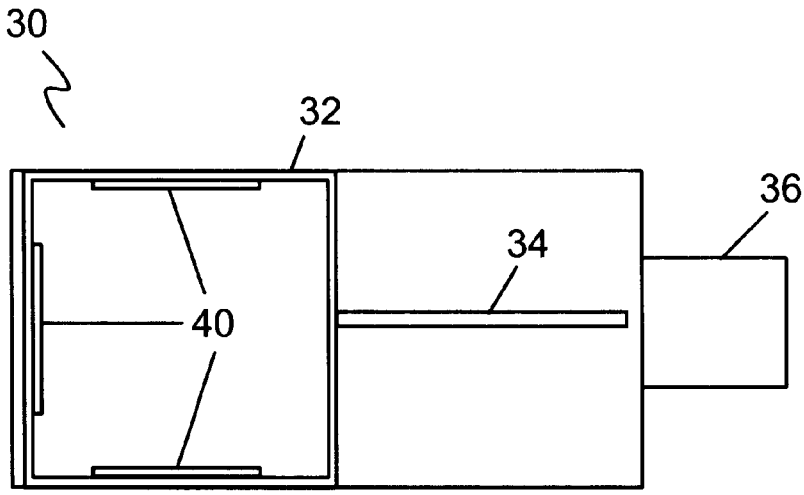
FIG. 3A is a top view of the tail assembly of the present invention.

FIG. 3A is a top view of tail assembly 30 showing spacers 40 connected to three sides of the inside surface of tail tube 32. Spacers 40 act as shims to provide a tighter sliding fit for receiving the lower end of vertical mast 50. Spacers 40 are preferably 2¼ inches wide by 6 inches long.

Figure 4:
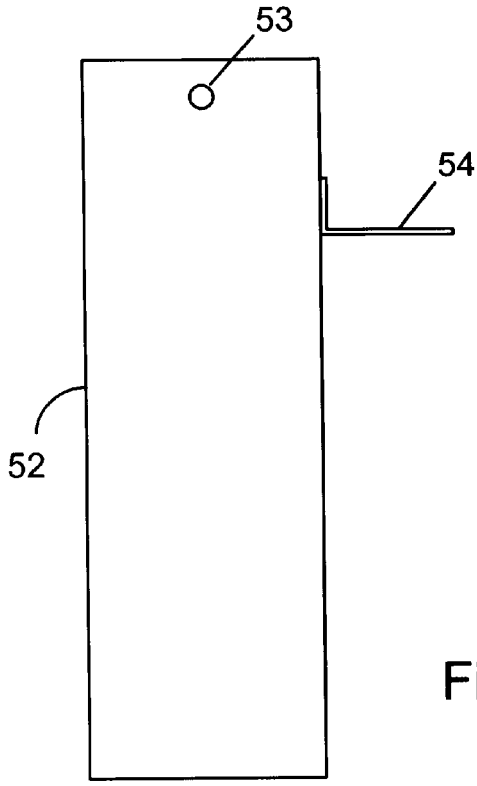
FIG. 4 is a side view of the present invention showing the lower mast.
Figure 4A:
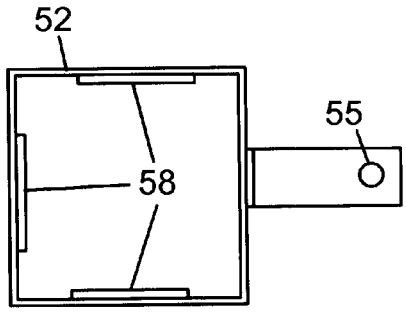
FIG. 4A is a top view of the lower mast.
Figure 5:
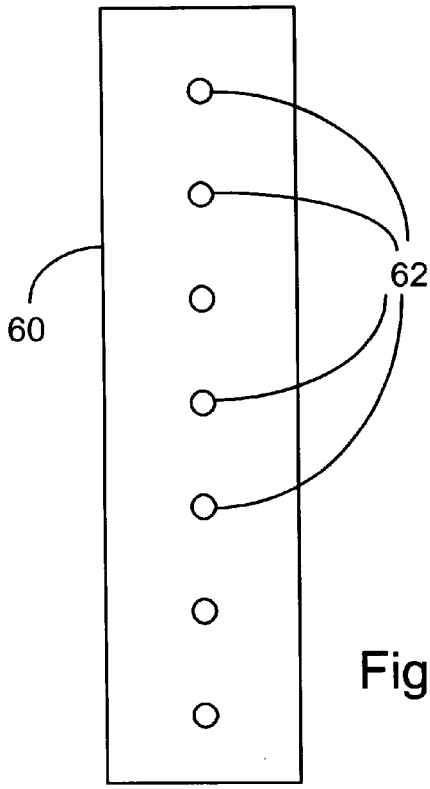
FIG. 5 is a side view of the present invention showing the middle mast.
Figure 6:
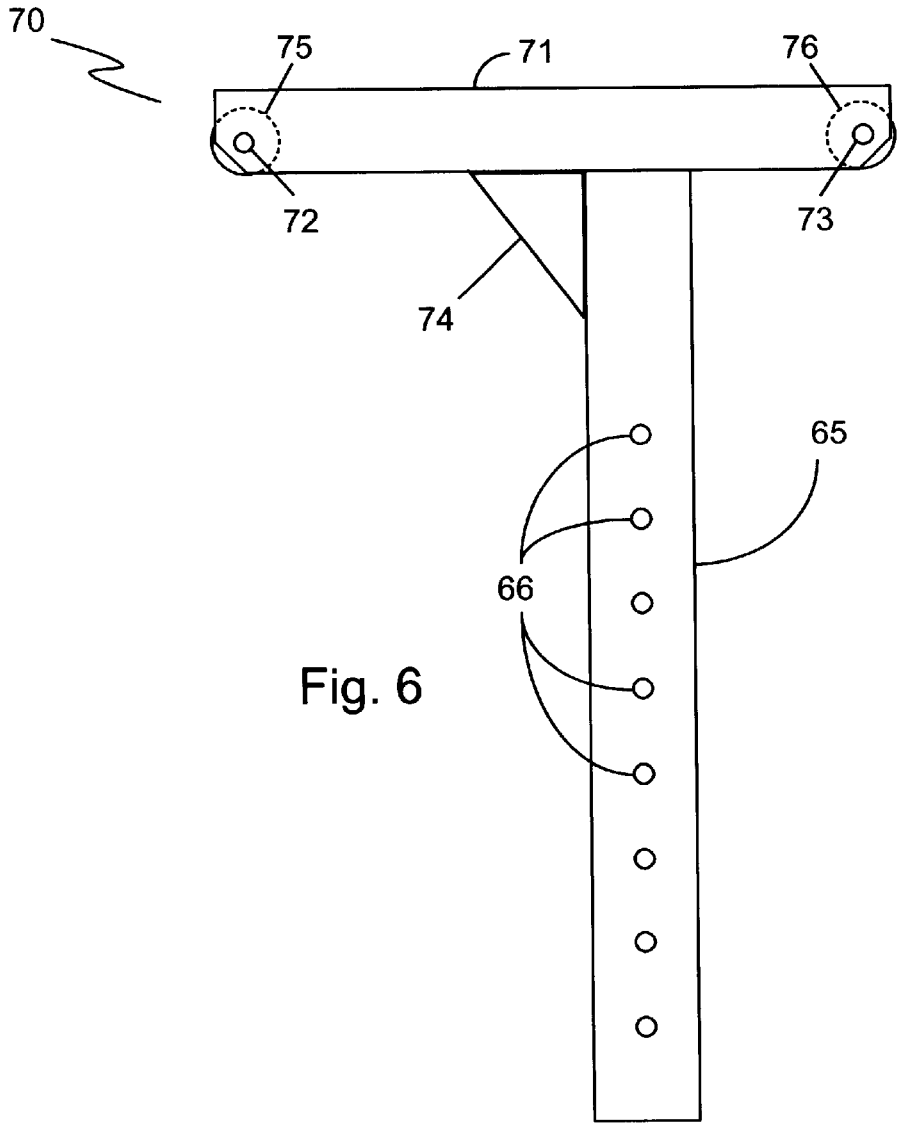
FIG. 6 is a side view of the present invention showing the upper mast and the cantilevered lifting beam.

As shown in FIGS. 4–6, mast 50 includes lower mast 52, intermediate mast 60 and upper mast 65. Turning now to FIG. 4, lower mast 52 is an elongated tubular structure having the same shape of, but a smaller cross-section than, tail tube 32 such that lower mast 52 is received into the inside of tail tube 32 as a sliding fit. Preferably, tubing with dimensions of 2½ inches by 2½ inches and a wall thickness of 3/16 inches is used. Lower mast 52 extends vertically upwardly from tail tube 32. The bottom of lower mast 52 may or may not be secured inside the hollow tail tube 32 and rests on the top of tail plate 31. Near the upper end of lower mast 52 is a through hole 53 between opposing sides of lower mast 52. Through hole 53 is sized to receive a pin, bolt or the like and is preferably a 7/16-inch hole. Lower mast 52 is preferably 20 inches long with the center of hole 53 located about ¼ inches from the upper end of lower mast 52. Attached on the backside of lower mast 52 is an L-shaped hold down bracket 54. Bracket 54 is preferably about ¼-inch thick, about 1 inch wide with the longer portion of the bracket being about 3 inches and the shorter end, which is secured to lower mast 52, being about 1¼ inches long. As illustrated in FIG. 4A, bracket 54 has a through hole 55 through the longer portion. Hole 55 is preferably a ¼-inch diameter hole whose center is about 2½ inches from the bend in L-shaped bracket 54. Lower mast 52 includes spacers 58 on three sides of the inside surface. Spacers 58 are shims to provide a snug, sliding fit with middle mast 60. Preferably, spacers 58 have dimensions of about 1¾ inches wide by about 20 inches long and a thickness of about 0.045 inches.

Figure 5A:
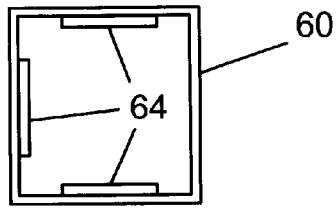
FIG. 5A is a top view of the middle mast.

As illustrated in FIG. 5, extending upwardly from and located inside of lower mast 52 is middle mast 60. Middle mast 60 is another elongated tubular structure having the same shape of, but a smaller cross section than, lower mast 52. Preferably, tubing with dimensions of 2 inches by 2 inches by 21 inches long and a wall thickness of about 3/16 inches is used. Middle mast 60 is ideally of a length such that, when inside lower mast 52, one end is protruding therefrom while the opposite end is bottomed out and resting on tail plate 31. Middle mast 60 has a plurality of through holes 62 through opposing sides. The centers of the holes 62 are about 2½ inches between adjacent holes. To obtain a snug, sliding fit, shims or spacers 64, or the like, as illustrated in FIG. 5A, may be inserted and otherwise secured to, the inside of middle mast 60. Spacers 64 are preferably 1¼ inches wide by 21 inches long. It should be understood by those skilled in the art that the spacers used in the present invention for providing a snug, sliding fit between the mast components may be attached either to the inside or outside of the mast sections, may be pieces that are at or near the ends only or cover the entire side of the mast section, and, if the spacers are equal in length to the mast sections, then the through holes discussed above would also penetrate through the-spacers.

Extending vertically upwardly from and located inside of middle mast 60, is upper mast 65. Upper mast 65 is yet another elongated, tubular structure having the same shape of, but a smaller cross section than, middle mast 60. Preferably, tubing with dimensions of about 1½ inches by about 1½ inches by 24 inches long and a wall thickness of about 3/16 inches is used. The top end of upper mast 65 is attached to lifting beam system 70.

The adjustability of mast 50 is particularly advantageous when using hoist 100 in a shop that services vehicles of varying sizes or when vehicles are jacked or otherwise lifted up off the garage floor. To adjust the height of vertical mast 50, middle mast 60 is moved vertically, upward or downward, until one of the plurality of holes 62, located along the side walls of middle mast 60, is aligned with lower mast hole 53, located in the side wall of lower mast 52. To secure the mast at this height, a bolt, roll pin, cotter pin, or other means well know in the art, is placed through the aligning holes 62 and 53. For the safety of the user and that of the component to be hoisted, the bolt, or other means used to secure the mast, should be locked in place by use of a nut or means commonly used in the trade. For convenience, the securing device may be lanyard to the mast by wire thread or the like. For further vertical adjustment of mast 50, upper mast 65 may be moved vertically in a similar fashion as that of middle mast 60, until one of the plurality of holes 66, located along the side walls of upper mast 65, is aligned with one of the plurality of holes 62 located along the side walls of middle mast 60. To secure the mast at this height, a bolt, roll pin, cotter pin, or other means well know in the art, is placed through the aligning holes of 66 and 62. For convenience, the securing device to be inserted through the pair of aligning holes may be tethered, with a wire rope, or the like, to mast 60 or 65.

As seen in FIG. 6, cantilevered lifting beam system 70 is secured to the top of the upper mast 65, preferably by welding. Lifting beam system 70 also includes a transverse beam 71, rollers/rotatable wheels 75, 76 secured near the ends of transverse beam 71 at through holes 72, 73 using bolts or pins, and the like (not shown). Transverse beam 71 is preferably a hollow square tube with dimensions of about 2 inches by about 2 inches by 14 inches long and a wall thickness of about ⅛ inches, but may also be round or rectangular, or a C-channel. Lifting beam system 70 is attached perpendicularly to the top of upper mast 65 such that the distance between the end of upper mast 65 where roller 75 is located to the edge of upper mast 65 is about 8½ inches. To provide additional lateral support to lifting beam system 70, optional beam brace 74 is fixedly mounted to the front side of upper mast 65 and the bottom of transverse beam 71. Brace 74 is preferably in the shape of a right triangle with equal sides of 3 inches in length and mounted along the centerlines of the upper mast 65 and the beam system 70. Although brace 74 has been illustrated in FIG. 6 as an angular plate, it will be appreciated by those skilled in the art that this reinforcing structure may also be comprised of a tubular member, either round or square, or a multitude of smaller solid brace members secured to the front, sides, backs, or in combination, of upper mast 65 and transverse beam 71.

Figure 7:
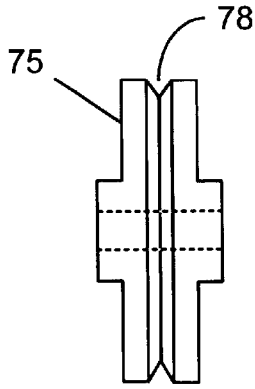
FIG. 7 is a detailed top view of the present invention showing the roller of the lifting beam.
Figure 7A:
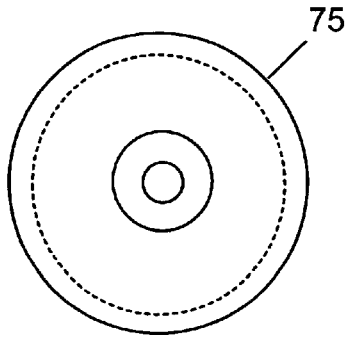
FIG. 7A is a side view of the present invention showing the roller of the lifting beam.

A front and side view of wheels 75, 76 are illustrated in FIGS. 7 and 7A. Rollers 75, 76 are of such a width as to fit inside transverse beam 71 with limited lateral movement while being freely rotatable. Rollers 75, 76 are provided with a groove 78, which is of such a depth and width for receiving and supporting lifting cable 82 (shown in FIG. 1). Rollers 75 and 76 are preferably made of aluminum, however, they made be made of steel or any other material such as nylon having sufficient strength to support the weight of the component being lifted. FIG. 7A is a side view of rollers 75, 76. Preferably, roller 75 and 76 are about 1⅕ inches in diameter and a width of about 1 11/16 inches. Groove 78 is about ⅜, inches wide and about 3/16 inches deep around the central outside circumference of roller 75 and 76.

As shown in FIG. 1, lifting system 80 includes lifting mechanism 81, lifting cable 82 and shackle 84. Lifting mechanism 81 is preferably a mechanically operated come-along, which is available as a standard item in most hardware and auto parts stores and the like. Although, it is equally as likely that a manual drum winch, electrical drum winch or other sort of lifting device known in the art for winding a hoist line about a drum or cylinder as a load is raised or lowered, may be employed.

Lifting mechanism 81 of system 80 is attached on one end, by bolting or other means, to hold down bracket 54 on lower mast 52, and on the opposite end to hold down hole 35. Winching mechanism 81 may be pivotally or fixedly connected to hold down bracket 54 and hold down hole 35 such that lifting mechanism 81 may or may not swivel. In the preferred embodiment, winching mechanism 81 is attached so that it is allowed to swivel. Of course, if the other aforementioned winching devices are to be used in hoist 100 other than that of the preferred embodiment, other bracketing supports designed to hold these other winching devices will be needed to accomplish the teachings of the present invention.

In the preferred embodiment, lifting system 80 employs wire rope as lifting cable 82. Lifting cable 82 may be a chain, nylon braided rope or other similar flexible tether. In any event, the first end of lifting cable 82 is securely attached to winching mechanism 81. The second end of lifting cable 82 extends vertically upward from mechanism 81 to roller 76, through transverse beam 71 to roller 75 such that lifting cable 82 is seated in groove 78 of rollers 75 and 76, and externally protrudes outwardly and downwardly from transverse beam 71 between base legs 14 and 16.

Attached to the protruding free end of lifting cable 82 is a load engaging component 84 generally designed as a shackle, but as will be appreciated by those skilled in the art, other appropriate load engaging mechanisms may also be used. When hoist 100 is in use, load engaging component 84 is attached directly or indirectly to the vehicle component to be hoisted.

The length of lifting cable 82 is altered, either upwardly or downwardly, by manipulating the handle on winching mechanism 81 by hand, in either a forward or reverse direction. The operation of the handle causes lifting cable 82 to wind or unwind from winching mechanism 81 and accordingly lifts or lowers the load attached to load engaging component 84.

When lifting system 80 is operated to hoist a load, the center of gravity of hoist 100 will remain within the area bounded by base 10. Further, any turning moment will be countered by tail assembly 30. This ensures the stability of hoist 100 and prevents it from overturning. Additionally, because of the shortness of base support 12 and the divergence of legs 14 and 16, hoist 100 requires a minimal amount of space underneath a vehicle when in use and maximizes the amount of floor space within which the technician has to work. Additionally, because hoist 100 has nine main components, i.e. base support 12, base legs 14 and 16, tail assembly 30, mast sections 52, 60 and 65, lifting beam system 70 and lifting system 80, it is simple and easy to manufacture. Furthermore, because hoist 100 is not adjustable in any plane except vertically, it is inherently stable.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A portable hoist comprising:

a base having a front and a back, said base comprising a transverse base member, a first leg and a second leg wherein said first leg and said second leg are spaced from each other and attached to said base member such that said first leg and said second leg form the front of said base;

a tail assembly attached to said base member, said tail assembly having at least a stabilizing leg at the back of said base;

an adjustable mast secured to said base member and extending orthogonally upward therefrom, said mast having at least a lower mast, an upper mast in slidable engagement with said lower mast and a locking mechanism for fixing the height of said adjustable mast;

a transverse lifting beam extending horizontally from the top of said mast, said beam having a first roller and a second roller attached to said beam, each roller being rotatably attached adjacent to an end of said beam; and a lifting system having a winching mechanism attached to said hoist adjacent said lower mast and said base wherein said winching mechanism swivels about an axis parallel to the vertical axis of said adjustable mast and a lifting cable extending upwardly from said winching mechanism to said first roller, said second roller and downwardly for a distance ending in a free end, said lifting cable being retractably engaged with said winching mechanism.

2. The hoist of claim 1 wherein said tail assembly further includes a mast coupler secured to said base member, said mast coupler extending orthogonally upward therefrom and securing said mast to said base.

3. The hoist of claim 2 wherein said tail assembly further includes a tail plate between said mast coupler and said base member.

4. The hoist of claim 3 wherein said tail assembly further includes a tail wing fixedly attached to a back of said mast coupler and the top said tail plate.

5. The hoist of claim 4 wherein said tail leg is secured to the bottom of said tail plate below said tail wing.

6. The hoist of claim 1 wherein said adjustable mast further includes a middle mast sized for slidable locking engagement between said lower mast and said upper mast.

7. The hoist of claim 6 wherein said lower mast, said middle mast and said upper mast are in telescopic arrangement where said middle mast slides into said lower mast and said upper mast slides into said middle mast.

8. The hoist of claim 1 wherein said winching mechanism is a mechanical winch.

9. A portable hoist comprising:

base having a front and a back, said base comprising a transverse base member, a first leg and a second leg wherein said first leg and said second leg are spaced from each other and attached to said base member such that said first leg and said second leg form the front of said base;

a tail assembly attached to said base member, said tail assembly having a tail plate, a tail tube secured to the top of said plate near the front, a tail wing secured in a vertical position to the top of said plate along a centerline of said plate and abutting said tail tube, and a tail leg attached to the bottom of said plate below said tail wing;

an adjustable mast secured to said base member and extending orthogonally upward therefrom, said mast having at least a lower mast, an upper mast and a locking mechanism for fixing the height of said adjustable mast;

a transverse lifting beam extending horizontally from and secured to the top of said mast, said beam having a first roller and a second roller attached to said beam, each roller being rotatably attached adjacent to an end of said beam; and a lifting system having a winching mechanism attached to said hoist adjacent said lower mast and said base wherein said winching mechanism swivels about a vertical axis adjacent and parallel to the central, vertical axis of said adjustable mast and a lifting cable extending upwardly from said winching mechanism to said first roller, said second roller and downwardly from said second roller for a distance ending in a free end, said lifting cable being retractably engaged with said winching mechanism.

10. The hoist of claim 9 wherein said adjustable mast is telescopic.

11. The hoist of claim 10 wherein said lower mast has at least one pair of through holes whose centers are on the same axis and wherein said upper mast has a plurality of through holes, wherein said adjustable mast further includes a locking pin for supporting engagement through said pair of holes of said lower mast and one pair of holes of said plurality of through holes of said upper mast.

12. The hoist of claim 10 wherein said adjustable mast further includes a middle mast in telescopic arrangement between said lower mast and said upper mast.

13. The hoist of claim 9 wherein said winching mechanism is one of a mechanical winch, an electrical winch and a pneumatic winch.

14. The hoist of claim 9 wherein said lower mast includes a hold down bracket on the back of said lower mast.

* * * * *